US011660520B2

(12) United States Patent
Chien

(10) Patent No.: US 11,660,520 B2
(45) Date of Patent: May 30, 2023

(54) PNEUMATIC BALL LAUNCHER

(71) Applicant: Kun-Lin Chien, Nantou County (TW)

(72) Inventor: Kun-Lin Chien, Nantou County (TW)

( * ) Notice: Subject to any disclaimer, the term of this patent is extended or adjusted under 35 U.S.C. 154(b) by 0 days.

(21) Appl. No.: 17/710,049

(22) Filed: Mar. 31, 2022

(65) Prior Publication Data

US 2022/0219060 A1 Jul. 14, 2022

Related U.S. Application Data

(62) Division of application No. 17/178,284, filed on Feb. 18, 2021, now Pat. No. 11,325,016.

(30) Foreign Application Priority Data

Dec. 3, 2020 (TW) ..... 109215973

(51) Int. Cl.

| | |
|---|---|
| ***A63B 69/40*** | (2006.01) |
| ***F41B 11/62*** | (2013.01) |
| *A63B 102/02* | (2015.01) |
| *A63B 102/18* | (2015.01) |
| *A63B 102/32* | (2015.01) |
| *A63B 102/16* | (2015.01) |
| *F41B 11/60* | (2013.01) |
| *F41B 11/68* | (2013.01) |

(52) U.S. Cl.

CPC ..... *A63B 69/409* (2013.01); *A63B 2102/02* (2015.10); *A63B 2102/16* (2015.10); *A63B 2102/18* (2015.10); *A63B 2102/182* (2015.10); *A63B 2102/32* (2015.10); *F41B 11/60* (2013.01); *F41B 11/62* (2013.01); *F41B 11/68* (2013.01)

(58) Field of Classification Search

CPC ..... F41B 11/00; F41B 11/60; F41B 11/62; F41B 11/64; F41B 11/58; F41B 11/70; F41B 11/723; A63B 2102/02; A63B 2102/16; A63B 2102/18; A63B 2102/182; A63B 2102/32; A63B 69/409

USPC ..... 124/61, 60, 63, 64, 73, 56

See application file for complete search history.

(56) References Cited

U.S. PATENT DOCUMENTS

| | | | | |
|---|---|---|---|---|
| 6,220,237 | B1 * | 4/2001 | Johnson | F41B 11/89 124/75 |
| 8,261,728 | B1 * | 9/2012 | Tseng | F41B 11/721 124/73 |
| 8,485,173 | B1 * | 7/2013 | Tseng | F41B 15/02 42/1.16 |
| 10,463,942 | B1 * | 11/2019 | Chien | A63B 69/409 |

(Continued)

*Primary Examiner* — John E Simms, Jr.
(74) *Attorney, Agent, or Firm* — WPAT, P.C.

(57) ABSTRACT

A pneumatic ball launcher includes a tube, a ball pathway unit, a push unit, a holding unit, an airway unit and a pneumatic unit. The ball pathway unit is used for connecting one end of the tube and wrapping part of a ball channel of the tube. The push unit includes a push bar, a slide base, a first driver and a second driver. The holding unit, detachably connected with the push unit, is used for holding the ball pushed by the push bar. The airway unit is connected with the holding unit. The pneumatic unit includes a valve mechanism, a pneumatic cylinder and a gas tank. When the valve mechanism opens to allow the gas tank to discharge into the holding unit via the airway unit, the ball held by the holding unit would be ejected out of the tube.

11 Claims, 14 Drawing Sheets

(56) References Cited

U.S. PATENT DOCUMENTS

| | | | | |
|---|---|---|---|---|
| 2011/0083653 | A1* | 4/2011 | Kawashima | F42B 8/02 124/57 |
| 2013/0247893 | A1* | 9/2013 | Yang | F41B 11/55 124/56 |
| 2013/0319389 | A1* | 12/2013 | Cho | F41B 11/723 124/73 |

* cited by examiner

PNEUMATIC BALL LAUNCHER

CROSS REFERENCE TO RELATED APPLICATION

This application is a divisional application of co-pending U.S. application Ser. No. 17/178,284, filed on Feb. 18, 2021, which claims the benefits of Taiwan application Serial No. 109215973, filed Dec. 3, 2020, the disclosures of which are incorporated by references herein in its entirety.

TECHNICAL FIELD

The present disclosure relates in general to a ball-ejecting device, and more particularly to a pneumatic ball launcher that has a ball-positioning structure.

BACKGROUND

Currently, various types of ball-launching apparatuses are already available in the marketplace. These ball-launching apparatuses are to eject balls (such as tennis, baseball, golf, table tennis, etc.) for providing people with the convenience of ball sports (especially when individuals practice alone).

In the art, a conventional ball-launching apparatus mainly includes an ejecting tube, a ball-feeding tube connecting to a lateral side of the ejecting tube and a compressed-air ejecting device connected to one axial end of the ejecting tube, in which the compressed-air ejecting device is further connected with a gas tank. The compressed air in the gas tank is suddenly discharged to generate an impulsive push for the compressed-air ejecting device to strongly drive the ball to move along the ejecting tube. In this apparatus, the ball-driving force is parallel to an axial direction of the ejecting tube. Thereupon, the ball can be ejected out of the ejecting tube from a free end thereof at a high speed.

In the aforesaid conventional ball-launching apparatus, the user can adjust the air pressure inside the gas tank so as to vary the ejection speed of the ball. Ideally, as long as setting of the apparatus is complete, balls would be continuously ejected by the same angle, direction and range. However, due to some structural factors, the balls inside the ejecting tube are unable to be ejected at the same launch position. In particular, the balls may stray inside the ejecting tube, and extremely continuity and the ejection speed of the ball may be unstable. In addition, if the ball has an uneven surface such as the baseball or softball with stitches, then the balls inside the ejecting tube may move unevenly, and thus the aforesaid shortcoming in the ejecting continuity and stability of the apparatus would be raised.

In addition, when the conventional ball-launching apparatus meets a structural problem, and disassembling of the ball-feeding tube or other parts might be necessary, the related maintenance and service work upon the aforesaid mechanisms is usually complicated and time-consuming.

Thus, the issue how to provide an improved pneumatic ball launcher that can overcome the aforesaid shortcomings is definitely urgent and important to the skill in the art.

SUMMARY

Accordingly, in view of the aforesaid shortcomings in the art, it is an object of the present disclosure is to provide a pneumatic ball launcher for resolving these shortcomings.

In one aspect of this disclosure, a pneumatic ball launcher includes a tube, a ball pathway unit, a push unit, a holding unit, an airway unit and a pneumatic unit. The tube has a first axial end, a second axial end opposite to the first axial end, and a ball channel thereinside to connect spatially the first axial end and the second axial end. The ball pathway unit is used for connecting one end of the tube and wrapping part of the ball channel. The push unit, having oppositely a third axial end and a fourth axial end, includes a push bar, a slide base, a first driver and a second driver. The push bar, perpendicular to the tube, is used for protruding into the ball channel. The slide base is disposed slidably between the third axial end and the fourth axial end. The first driver, mounted at the slide base, is connected with the push bar for controlling the push bar to longitudinally displace in the ball channel to a fixed position. The second driver, connected with the slide base for controlling the slide base to displace, is used for moving the push bar along the tube to further push a ball to approach the first axial end. The holding unit, detachably connected with the first axial end, is used for holding the ball pushed by the push bar. The airway unit is connected with one end of the holding unit. The pneumatic unit includes a valve mechanism, a pneumatic cylinder and a gas tank. The valve mechanism has an exhalation end connected with the airway unit. The pneumatic cylinder, connected with the valve mechanism at one end thereof connecting the airway unit, is used for controlling the valve mechanism to close or open the exhalation end. The gas tank, connected with the valve mechanism, is used for storing a compressed air. When the valve mechanism opens the exhalation end, the compressed air in the gas tank is discharged into the holding unit via the airway unit to eject the ball out of the tube via the second axial end. An inner diameter of the tube is greater than an outer diameter of the ball, such that the flight pathway and the velocity of the ejected ball won't be affected.

In one embodiment of this disclosure, the holding unit has a sealing ring for holding the ball pushed by the push bar.

In one embodiment of this disclosure, the holding unit has a taper opening for holding the ball pushed by the push bar.

In one embodiment of this disclosure, the ball pathway unit and the airway unit are detachably connected via a connecting pipe.

In one embodiment of this disclosure, the valve mechanism includes an outer casing and a valve. The outer casing, having one end formed as the exhalation end, the pneumatic cylinder being disposed at another end of the outer casing opposite to the exhalation end. The valve, disposed inside the outer casing, has one end thereof connected with the pneumatic cylinder and another end thereof facing the exhalation end. The pneumatic cylinder moves the valve with respect to the exhalation end to close or open the exhalation end.

In one embodiment of this disclosure, the valve mechanism has a compressed gas inlet for introducing a compressed air into the gas tank via the valve mechanism.

In one embodiment of this disclosure, the valve mechanism is connected with one end of the airway unit, another end of the airway unit is spatially connected with the ball channel, and the airway unit is perpendicular to the tube. In addition, the air out-going direction of the exhalation end is perpendicular to a longitudinal direction of the airway unit.

In one embodiment of this disclosure, the tube bifurcates a ball-feeding unit, and the ball-feeding unit includes a ball pathway and a stop block. The ball pathway, used for carrying a plurality of balls, is connected spatially with the ball channel. The stop block, disposed at a connection of the ball pathway and the ball channel, is displaced between a close position and an open position. When the stop block is at the close position, a spatial communication between the ball pathway and the tube is blocked. When the stop block is at the open position, the spatial communication between the ball pathway and the tube is made through so as to have the ball in the ball pathway to fall into the ball channel.

In one embodiment of this disclosure, an inner diameter of the tube is greater than an outer diameter of the ball.

In another aspect of this disclosure, a pneumatic ball launcher includes a first tube, a ball pathway unit, a push unit, a second tube, a holding unit, an airway unit, a third driver and a pneumatic unit. The first tube has a first axial end, a second axial end opposite to the first axial end, and a first ball channel thereinside to connect spatially the first axial end and the second axial end. The ball pathway unit is used for connecting one end of the first tube and wrapping part of the first ball channel. The push unit, having oppositely a third axial end and a fourth axial end, includes a first push bar, a slide base, a first driver and a second driver. The first push bar, perpendicular to the first tube, is used for protruding into the first ball channel. The slide base is disposed slidably between the third axial end and the fourth axial end. The first driver, mounted at the slide base, is connected with the first push bar for controlling the first push bar to longitudinally displace in the first ball channel to a fixed position. The second driver, connected with the slide base for displacing the slide base, is used for moving the first push bar along the first tube to further push a ball to approach the first axial end. The second tube has one end connected with the ball pathway unit and a second ball channel formed thereinside. The holding unit is disposed slidably in the second tube for holding the ball pushed by the first push bar. The airway unit is connected with another end of the second tube. The pneumatic unit includes a valve mechanism, a pneumatic cylinder and a gas tank. The valve mechanism has an exhalation end connected with the airway unit. The pneumatic cylinder, connected with the valve mechanism at another end thereof opposite to the end connecting the airway unit, is used for controlling the valve mechanism to close or open the exhalation end. The gas tank, connected with the valve mechanism, is used for storing a compressed air. When the valve mechanism opens the exhalation end, the compressed air in the gas tank is discharged into the second tube via the airway unit to eject the ball out of the first tube via the second axial end.

In one embodiment of this disclosure, the third driver utilizes a buckle unit to detachably connect a protrusive portion of the holding unit, and the buckle unit includes a buckling portion and a pin portion. The buckling portion is used for buckling the protrusive portion of the holding unit. The pin portion is used for pushing the holding unit to separate the buckling portion from the protrusive portion of the holding unit.

In one embodiment of this disclosure, the third driver utilizes a second push bar to control the buckle unit to displace in the second tube.

In one embodiment of this disclosure, the ball pathway unit and the airway unit are detachably connected via the second tube.

In one embodiment of this disclosure, an inner diameter of the first tube is greater than an outer diameter of the ball, and an inner side wall of the second tube can be mirror polished and treated with chemical nickel.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
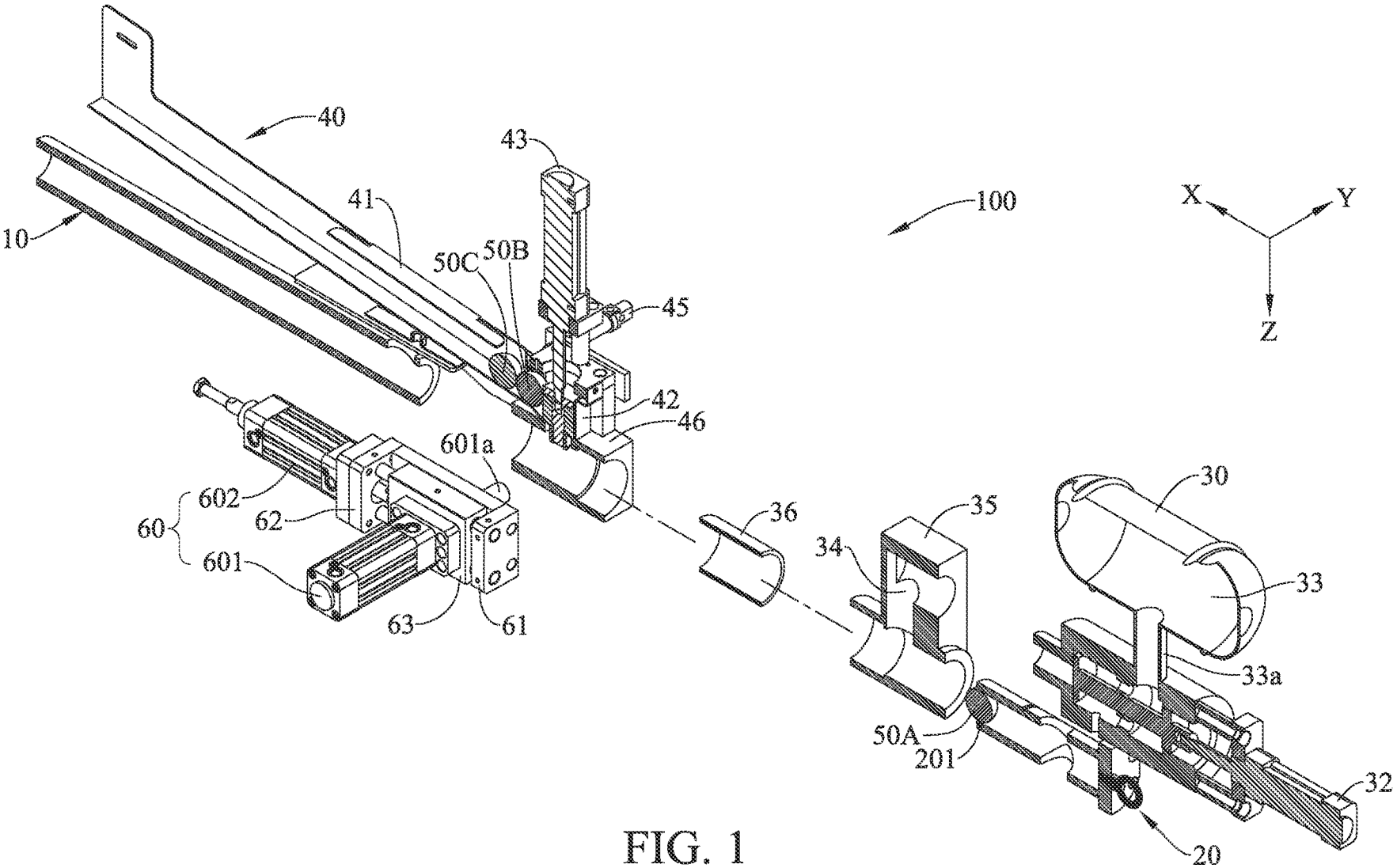
FIG. 1 is a schematic exploded and cross-sectional view of a first embodiment of the pneumatic ball launcher in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1, a first embodiment 100 of the pneumatic ball launcher includes mainly a tube 10, a ball pathway unit 46, a connecting pipe 36, a holding unit 20, a push unit 60, an airway unit 35 and a pneumatic unit 30.

The ball pathway unit 46 and the airway unit 35 are detachable connected via the connecting pipe 36. As shown, one end of the ball pathway unit 46 is shaped to have an inner step structure for receiving the connecting pipe 36 to further connect with the airway unit 35. Practically, the connecting pipe 36 can be made of a metal or a non-metallic material. In the first embodiment of this disclosure, the tube 10, the ball pathway unit 46, the connecting pipe 36, the holding unit 20, the push unit 60, the airway unit 35 and the pneumatic unit 30 are all modular designs, thus related maintenance and service can be much convenient, and the product reliability can be substantially enhanced.

The push unit 60, disposed at a lateral side of the ball pathway unit 46, includes a push bar 601*a*, two drivers 601, 602 and a slide base 63. An axial direction (Y-axis direction) of the push bar 601*a* is perpendicular to another axial direction (X-axis direction) of the tube 10, and the push bar 601*a* can displace into the ball channel 13 in the Y-axis direction.

The push unit 60 has oppositely a third axial end 61 and a fourth axial end 62. The driver 601 is connected with the slide base 63. An axial line connecting the third axial end 61 and the fourth axial end 62 is parallel to a Z-axis direction.

The first driver 601 controls the push bar 601*a* to displace in the Y-axis direction between a standby position and a push position in the ball channel 13.

The first driver 601 is perpendicular to the second driver 602. According to this disclosure, the first driver 601 and the second driver 602 can be pneumatic cylinders, hydraulic tanks, mechanical devices, electric devices or the like devices.

The first driver 601, mounted at the slide base 63, and the slide base 63 is slidably disposed between the third axial end 61 and the fourth axial end 62.

The second driver 602, connected to one end of the slide base 63, is to control the displacement of the slide base 63 so as to allow the push bar 601*a* to push a ball 50A located close to a first axial end 11 to slide along the tube 10 in the axial direction. Practically, when the slide base 63 is pushed to the third axial end 61 by the second driver 602, the push bar 601*a* would move with the slide base 63 to push the ball 50A along the tube 10 to be held by the sealing ring 201 of the holding unit 20, such that the ball 50A can be well positioned.

Another end of the ball pathway unit 46 is to connect with one end of the tube 10, while the other end of the ball pathway unit 46 is to sleeve part of the connecting pipe 36.

Figure 2:
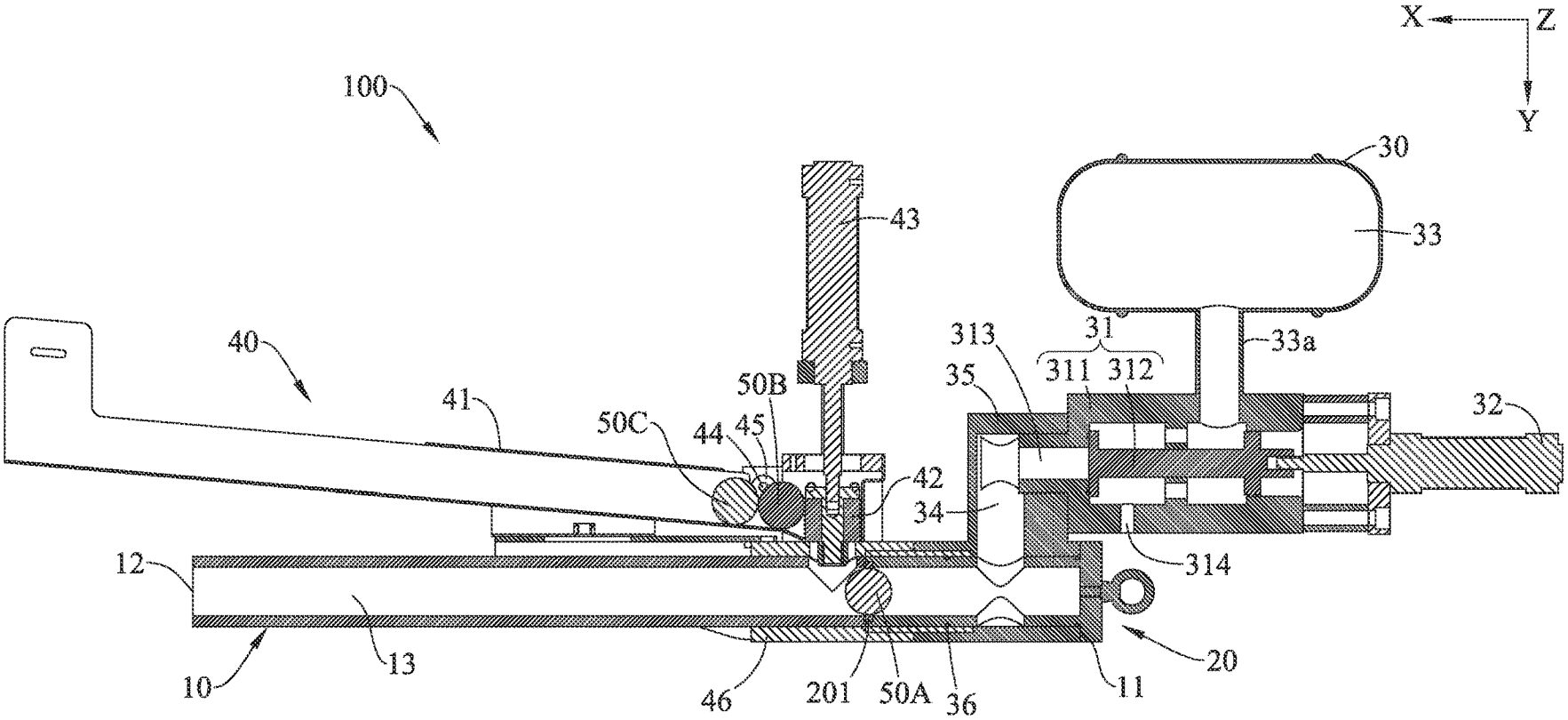
FIG. 2 is a schematic cross-sectional view of FIG. 1.

As shown in FIG. 2, the pneumatic unit 30 includes a valve mechanism 31, a pneumatic cylinder 32 and gas tank 33. The valve mechanism 31 includes an outer casing 311 and a valve 312. One end of the outer casing 311 is formed as an exhalation end 313 to connect the airway 34, while another end thereof is connected with the pneumatic cylinder 32. The valve 312, disposed inside the outer casing 311, has one end to connect the pneumatic cylinder 32, while another end thereof is close to the exhalation end 313. By having the pneumatic cylinder 32 to move the valve 312 of the valve mechanism 31 with respect to the exhalation end 313, the exhalation end 313 can be either closed or opened. As shown in FIG. 2, the exhalation end 313 is in a close state.

The valve mechanism 31 is connected to one end of the airway unit 35, and another end of the airway unit 35 is connected spatially with the airway 34. A longitudinal direction (Y-axis direction) of the airway unit 35 is perpendicular to the axial direction (X-axis direction) of the ball channel 13. A discharge direction (X-axis direction) of the exhalation end 313 is perpendicular to the longitudinal direction (Y-axis direction) of the airway unit 35. The gas tank 33 is connected with the valve mechanism 31 via a connecting pipe 33*a*. The valve mechanism 31 has a compressed gas inlet 314 for providing the compressed air to the valve mechanism 31, and further to the gas tank 33. The compressed air is stored inside the gas tank 33. As shown in FIG. 2, the exhalation end 313 is in a close state.

Referring to FIG. 2, in order to clearly show the way of the holding unit 20 to hold the ball 50A thereinside, the tube 10, the ball pathway unit 46, the connecting pipe 36, the holding unit 20, the airway unit 35 and the pneumatic unit 30 are all illustrated in a cross-sectional manner, but particularly the push unit 60 is omitted.

The tube 10 has a first axial end 11, a second axial end 12 opposite to the first axial end 11, and the ball channel 13 connecting the first axial end 11 and the second axial end 12 inside the tube 10.

A ball-feeding unit 40, bifurcation from the tube 10, includes a ball pathway 41 and a stop block 42 connecting the pathway 41. The ball pathway 41, used for carrying a plurality of balls 50B-50C, is connected spatially with the ball channel 13. The stop block 42 is disposed at the connection of the ball pathway 41 and the ball channel 13. The stop block 42, connected with and also controlled by the driver 43, is to displace in the Y-axis direction between a close position and an open position. In this disclosure, the driver 43 can be a pneumatic cylinder, a hydraulic tank, a mechanical device, an electric device or any the like. As shown in FIG. 2, the stop block 42 is at the close position to interrupt the spatial connection between the ball pathway 41 and the ball channel 13. As the stop block 42 is elevated to reach the open position, the spatial connection between the ball pathway 41 and the ball channel 13 can be established, such that the balls 50A-50C in the ball pathway 41 can be provided automatically into the ball channel 13 by gravity.

In order to ensure that only one ball can be supplied to the ball channel 13 in each open operation, thus a stop lever 44 can be introduced. An axial direction (Z-axis direction) of the stop lever 44 is perpendicular to the longitudinal direction (X-axis direction) of the ball channel 13. The stop lever 44 is connected with the driver 45, and so the driver 45 can control the stop lever 44 to displace in the axial direction (Z-axis direction) between a protrusive position and a retrieval position. In this disclosure, the driver 45 can be a pneumatic cylinder, a hydraulic tank, a mechanical device, an electric device or any the like.

As shown in FIG. 2, the stop lever 44 is at the retrieval position, and thus the balls 50B-50C are stopped by the stop block 42 for not falling into the ball channel 13. As the stop block 42 is elevated to reach the open position, the stop lever 44 also reaches the protrusive position to provide a free end thereof to contact one side of the ball 50B in the ball pathway 41, such that a plurality of balls 50B-50C can be retained in the ball pathway 41. Thereupon, it can be ensured that only the ball 50A close to the stop block 42 in the ball pathway 41 is allowed to drop into the ball channel 13.

The holding unit 20 has two through holes extended radially to align with the airway 34 of the airway unit 35, and thus to connect spatially with the airway 34. The holding unit 20 is connected with the first axial end 11 of the tube 10. Practically, the holding unit 20 can be inserted into the airway unit 35, the connecting pipe 36 and the ball pathway unit 46, and can be fixed to one end of the airway unit 35 by specific fasteners such as screws.

It is noted that the holding unit 20 of the first embodiment is connected with the first axial end 11 of the tube 10 in a detachable manner, such that maintenance of the sealing ring 201 can be much easier. In this disclosure, the sealing ring 201 can be made of SILICONE/VMQ, FPM/FKM/VITON, CR/NEOPRENE, NBR/NITRILE/BUNA-N, HNBR or any elastic material the like.

It shall be explained that the drivers 43, 45, 601 and 602, the pneumatic cylinder 32 and the valve 312 can be controlled by a computer or adequate programs. In addition, the magnitude of the forcing for ejecting the ball is related to the capacity of the gas tank 33 and the air pressure entering the gas tank 33.

Referring now to FIG. 2, and FIG. 3A to FIG. 3E, operation of the pneumatic ball launcher of this disclosure includes the following steps.

Figure 3A:
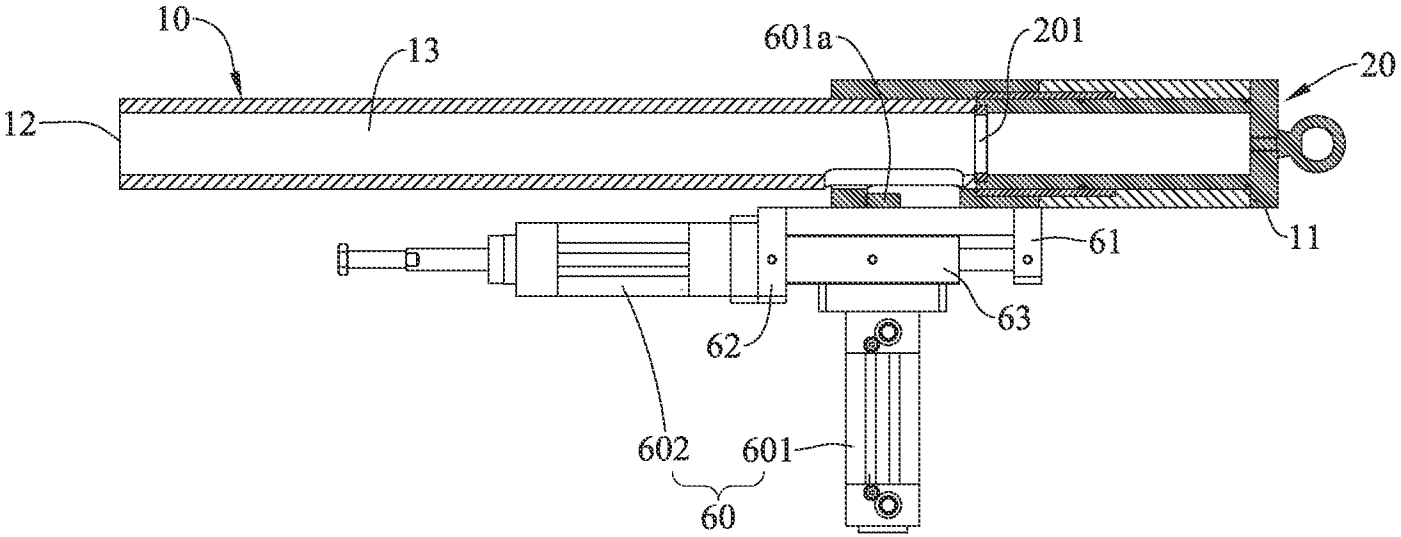
FIGS. 3A-3E show, in schematic cross-sectional views, different operation stages of the first embodiment of the pneumatic launcher in accordance with this disclosure.

Step 1: As shown in FIG. 2 and FIG. 3A, the stop block 42 is at the close position to retain the balls 50A-50C in the ball pathway 41, the push bar 601*a* is at the standby position, the compressed air is remained inside the gas tank 33, and the exhalation end 34 is closed.

Figure 3B:
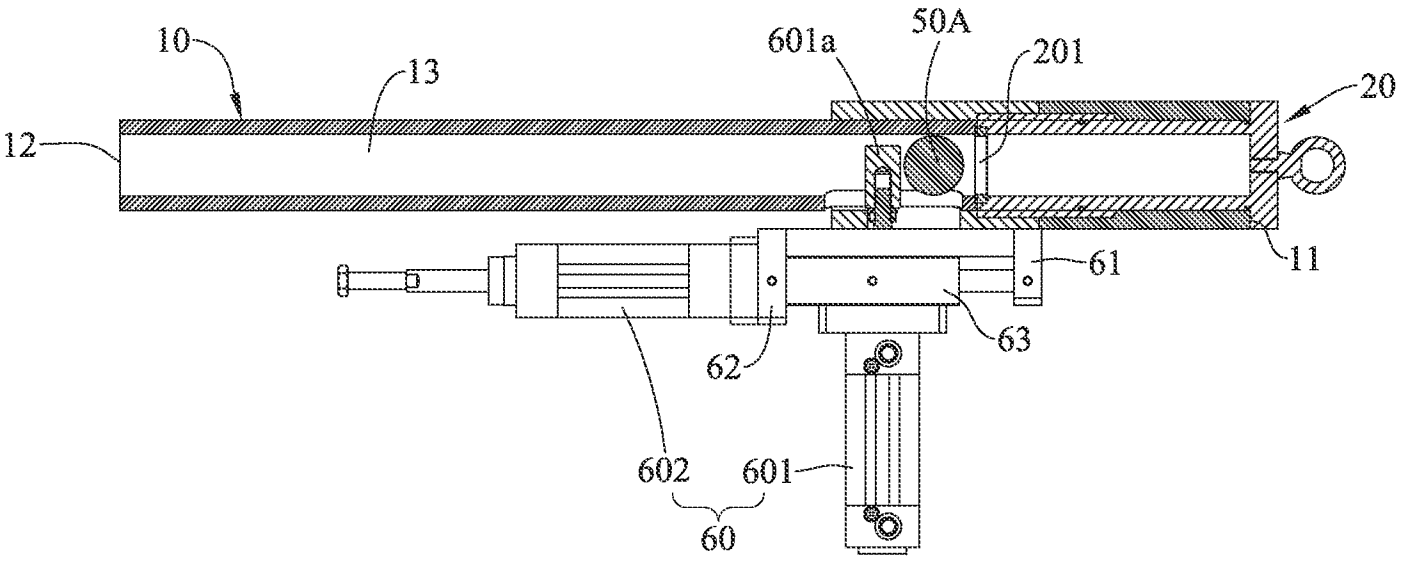

Step 2: As shown in FIG. 2 and FIG. 3B, the driver 601 of the push unit 60 protrudes the push bar 601*a* into the ball channel 13, the stop block 42 is elevated to the open position so as to have the stop lever 44 to reach the protrusive position to retain the balls 50B-50C in the ball pathway, and the ball 50A drops into the ball channel 13 to form contact with the push bar 601*a*.

Figure 3C:
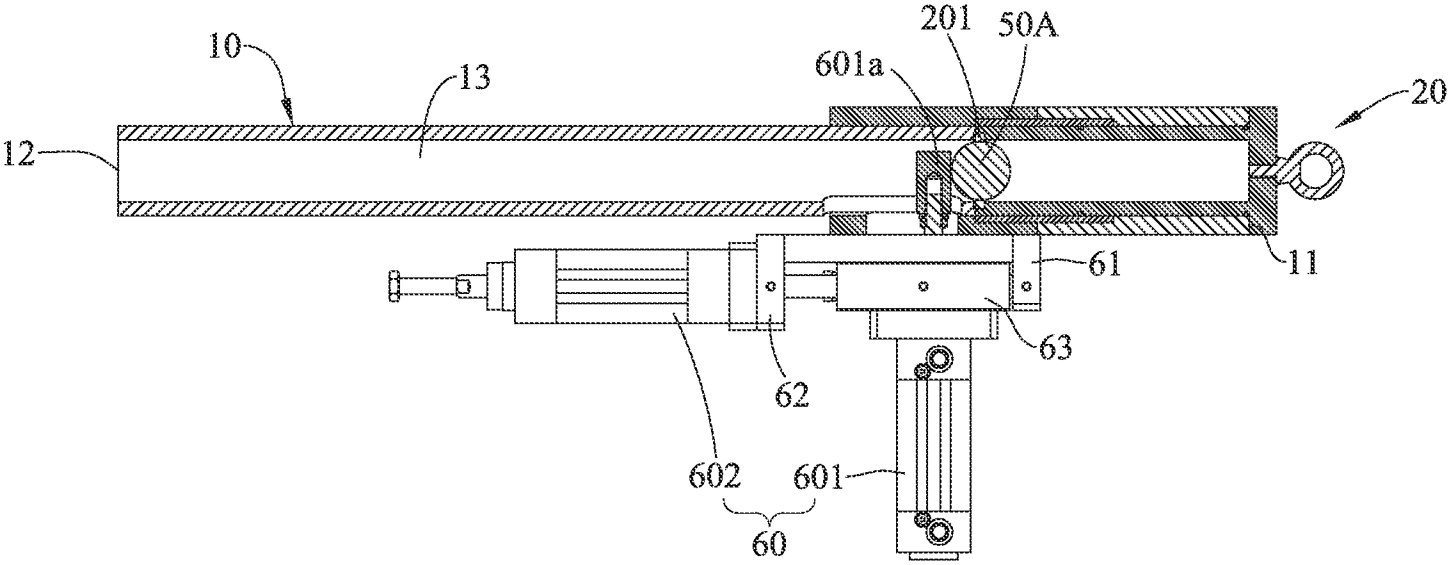

Step 3: As shown in FIG. 2 and FIG. 3C, after the ball 50A falls into the ball channel 13, the stop block 42 is lowered back to the close position so as to retrieve the stop lever 44 back to the retrieval position, the driver 602 pushes the slide base 63 to move toward the third axial end 61, and then the push bar 601*a* drives the ball 50A to approach the holding unit 2 till a portion of the ball 50A is held by the sealing ring 201 in the holding unit 20.

Figure 3D:
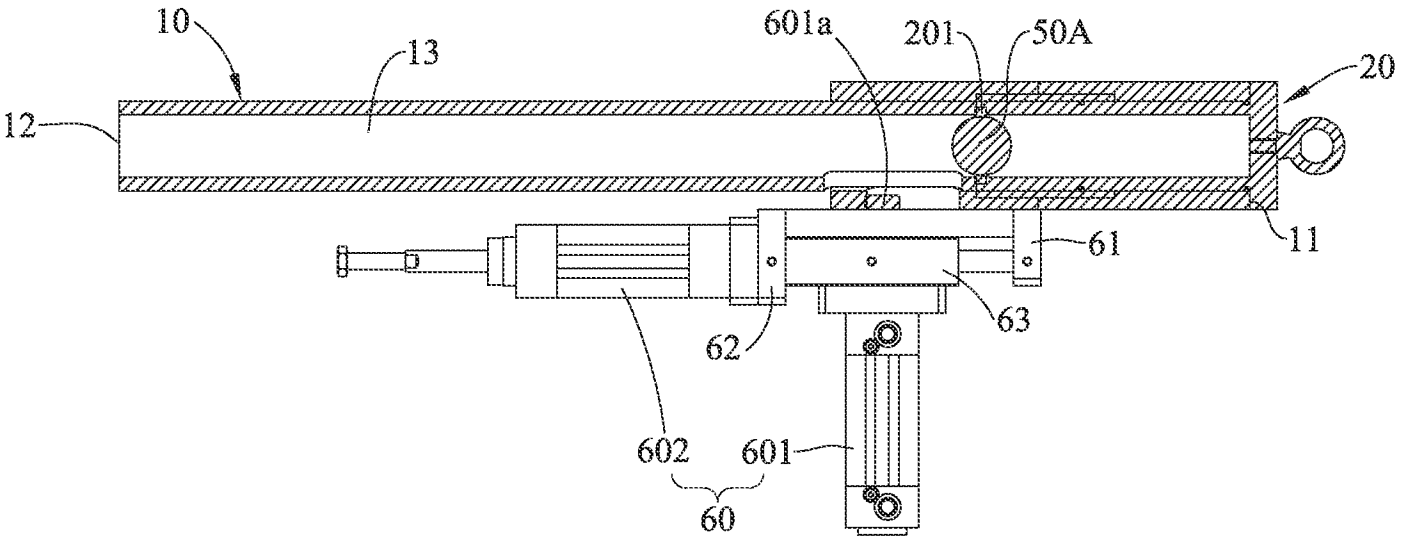

Step 4: As shown in FIG. 2 and FIG. 3D, both the first driver 601 and the second driver 602 resume their own initial states and initial positions, and the slide base 63 contacts the fourth axial end 62.

Figure 3E:
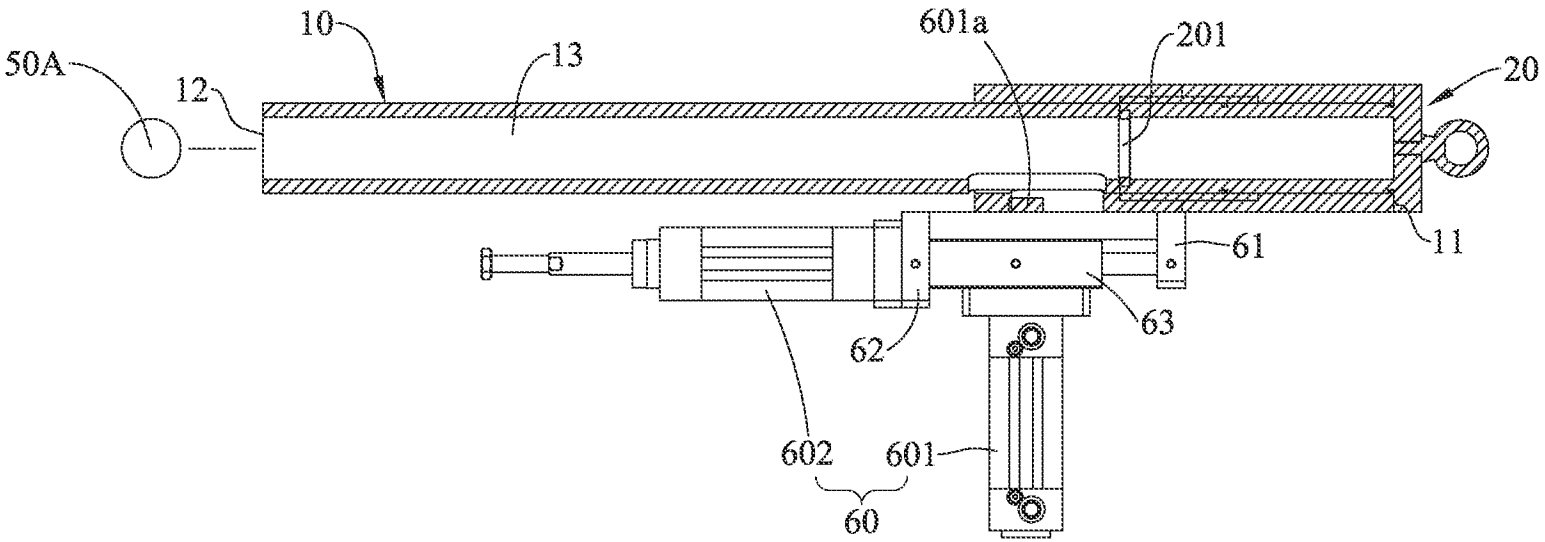

Step 5: As shown in FIG. 2 and FIG. 3E, the pneumatic cylinder 32 pulls the valve 312 to open the exhalation end 313 so as to suddenly discharge the compressed air inside the gas tank 33 into the airway unit 35, the holding unit 20 and the ball channel 13, and thus the ball 50A is ejected out of the tube 10 via the second axial end 12. In this embodiment, with the holding unit 20, the ball 50A can be located to an ejection position in the ball channel 13. In accordance with the first embodiment of this disclosure, the ball can be a tennis, a baseball, a golf, a table tennis or any non-metallic ball. In addition, with the inner diameter of the tube 10 to be greater than the outer diameter of the ball 50A, such that the flight path and velocity of the ball 50A won't be affected.

After the ball 50A is ejected, then go back to Step 1 to have the push bar 601*a* stopped at the standby position, the valve 312 is closed, and then Steps 2-5 can be orderly performed to eject another ball. By repeating Steps 1-5, the balls can be ejected continuously.

Figure 4:
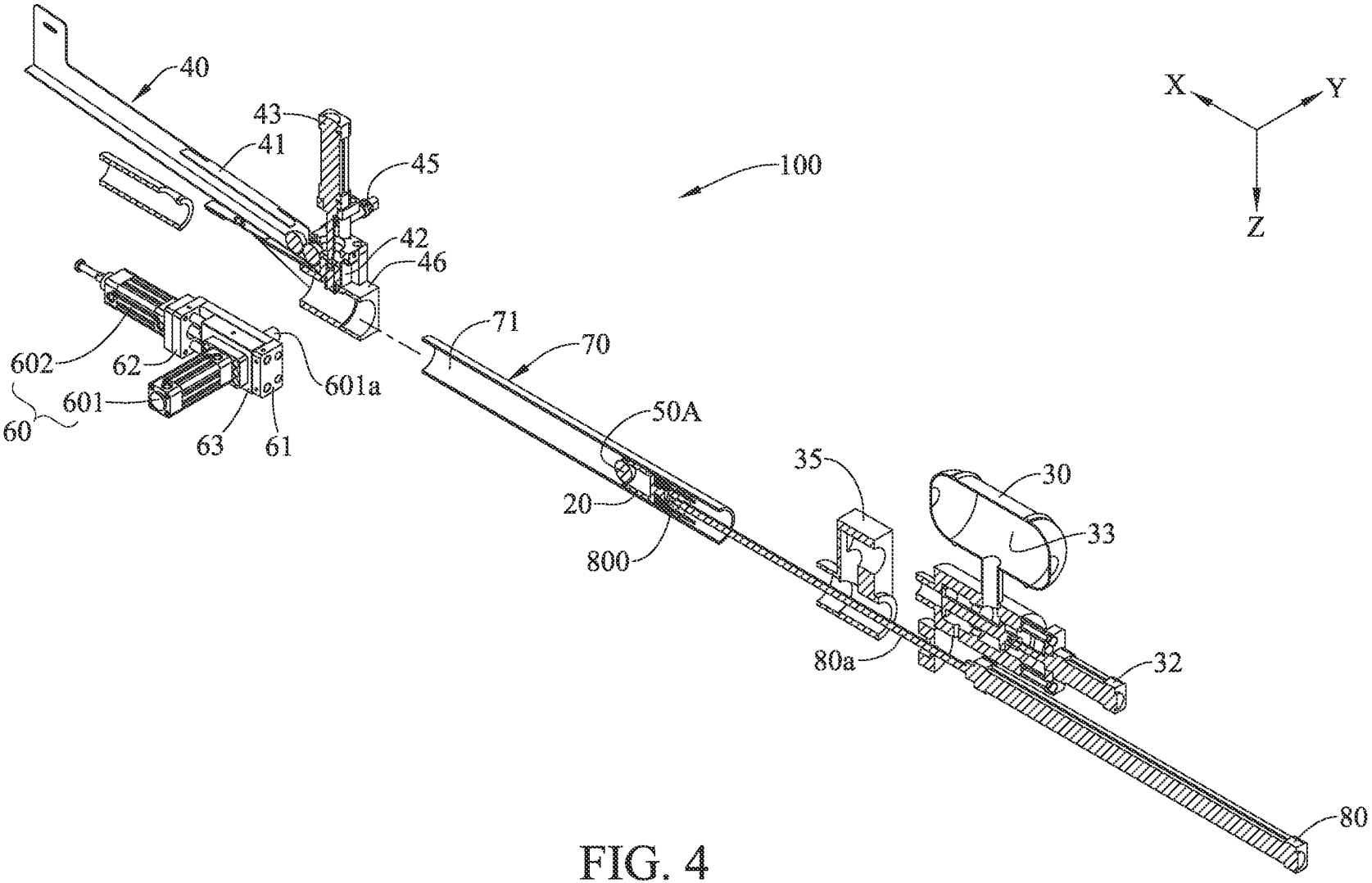
FIG. 4 is a schematic exploded and cross-sectional view of a second embodiment of the pneumatic ball launcher in accordance with this disclosure.

Referring to FIG. 4, an exploded view of a second embodiment of the pneumatic ball launcher in accordance with this disclosure is schematically shown. A difference between this second embodiment and the aforesaid first embodiment is that, in this second embodiment, the holding unit 20 is further furnished with a protrusive portion 20*a*. Thereupon, the driver 80 can be buckled to the holding unit 20 so as to control the movement of the holding unit 20 in the second ball channel 71 of the second tube 70. Practically, the driver 80 can be buckled with the protrusive portion 20*a* of the holding unit 20 via a buckle unit 800.

Figure 5A:
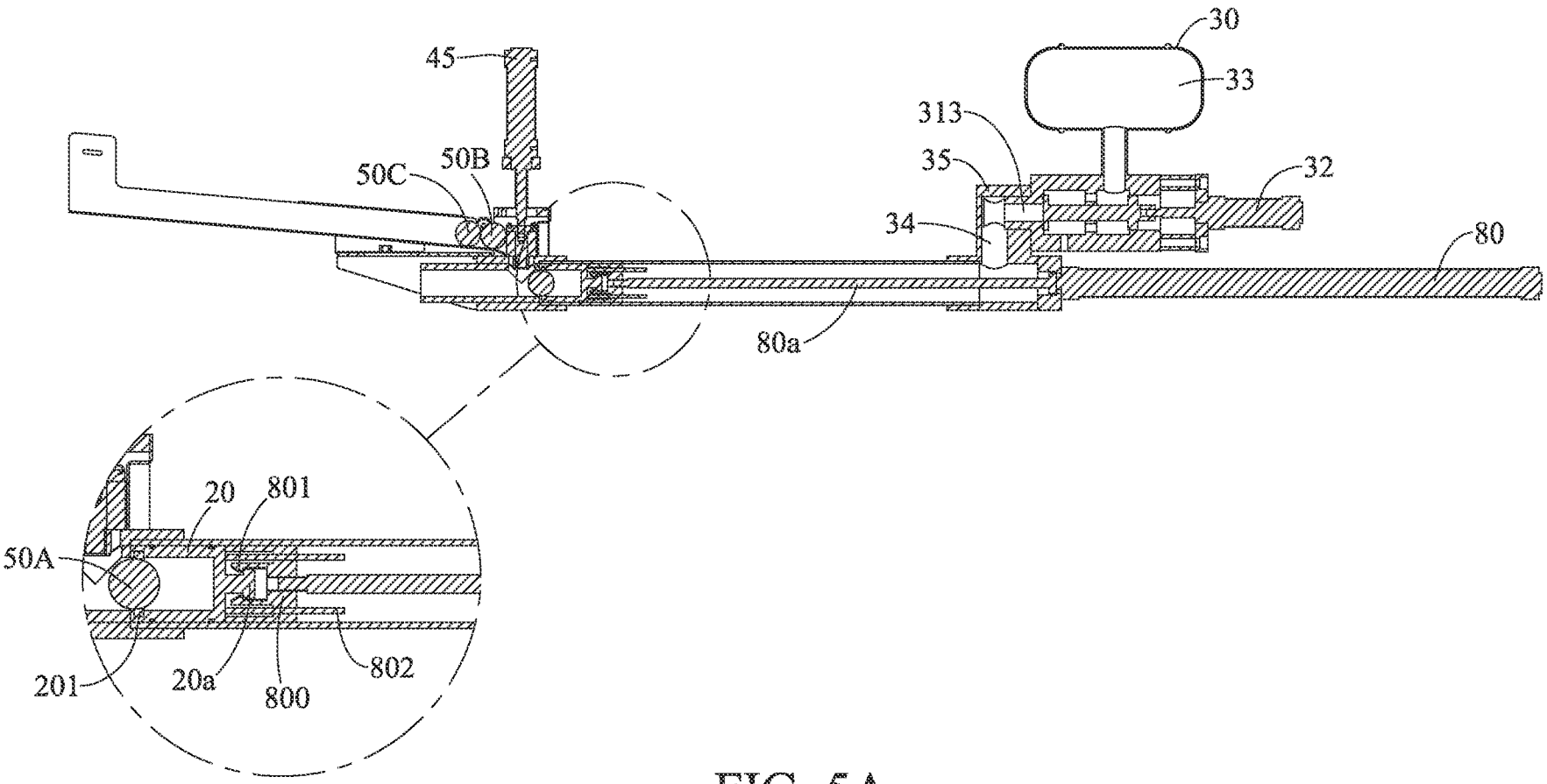
FIGS. 5A-5D show, in schematic cross-sectional views, different operation stages of the second embodiment of the pneumatic launcher in accordance with this disclosure.

As shown in FIG. 5A, the buckle unit 800 includes a buckling portion 801 and a pin portion 802. The buckling portion 801 is used for buckling the protrusive portion 20*a* of the holding unit 20, and the pin portion 802 is used for pushing the holding unit 20 so as to separate the buckling portion 801 from the protrusive portion 20*a* of the holding unit 20. As shown in FIG. 4, the driver 80 is connected to one end of the airway unit 35, while another end of the airway unit 35 is detachably connected to the ball pathway unit 46 via the second tube 70.

It is noted that, in this second embodiment, the tube 10, the ball pathway unit 46, the second tube 70, the holding unit 20, the push unit 60, the airway unit 35 and the pneumatic unit 30 are all modular designs, such that related maintenance and service can be much convenient, and the product reliability can be substantially enhanced as well.

Referring to FIG. 4, and FIG. 5A through FIG. 5D, operation of the second embodiment of the pneumatic ball launcher of this disclosure includes the following steps.

Step 10: As shown in FIG. 4 and FIG. 5A, after the ball 50A is pushed to enter the sealing ring 201 of the holding unit 20 via the push bar 601*a*, the compressed air is stayed in the gas tank 33, and the exhalation end 313 is in a close state. Then, the buckle unit 800 is buckled with the protrusive portion 20*a* of the holding unit 20.

Figure 5B:
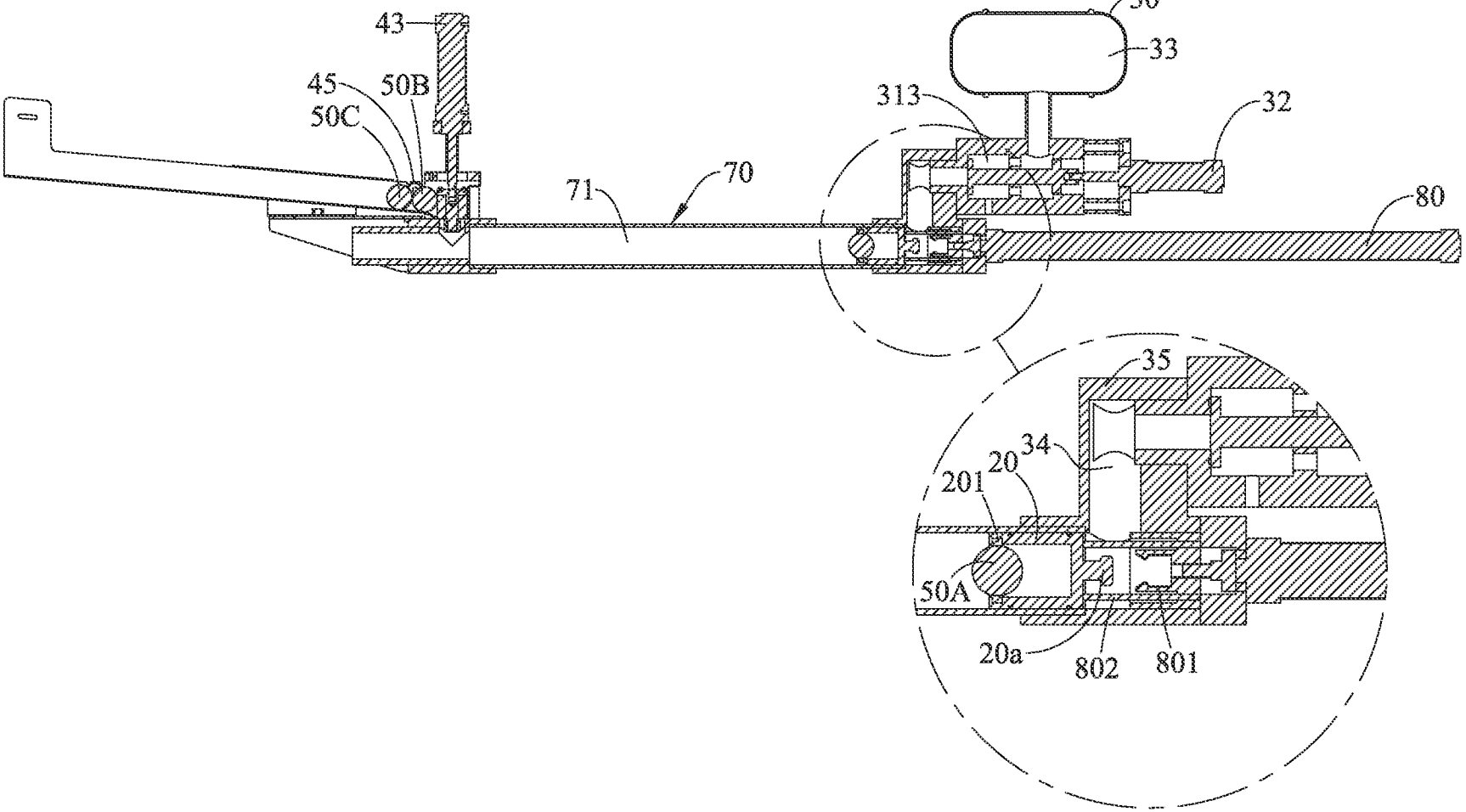

Step 20: As shown in FIG. 4 and FIG. 5B, when the push bar 80*a* is retrieved back into the driver 80, the pin portion 802 is pushed out in the axial direction of the second tube 70 to contact at a bottom portion of the holding unit 20 so as to leave the clip portion 801 from the protrusive portion 20*a*.

Figure 5C:
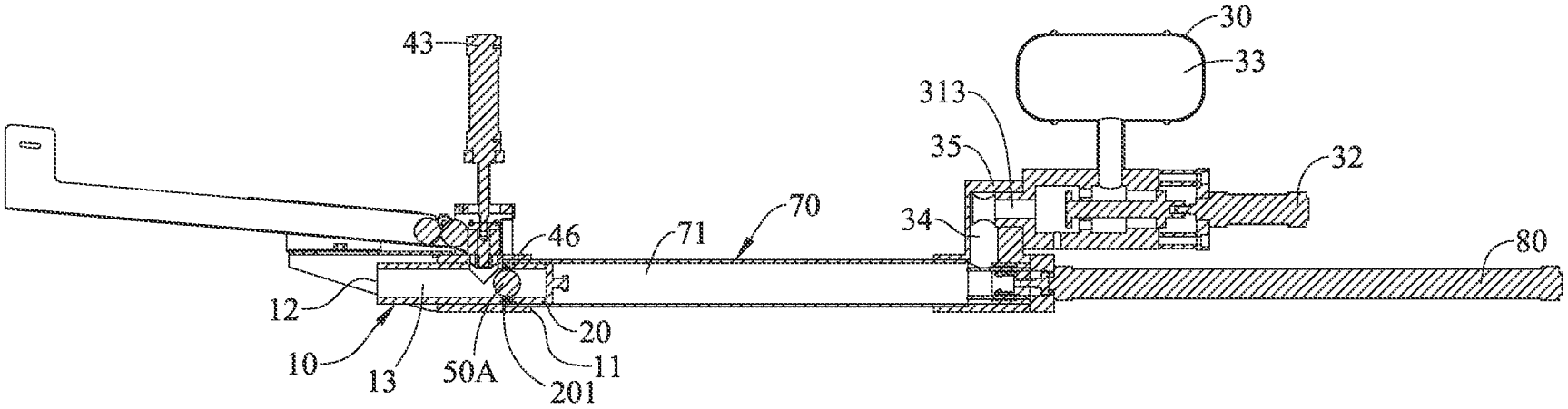

Step 30: As shown in FIG. 4 and FIG. 5C, the pneumatic cylinder 32 pulls the valve 312 to open the exhalation end 313 so as to suddenly discharge the compressed air inside the gas tank 33 into the airway unit 35, the holding unit 20 and the second ball channel 71. Thereupon, the holding unit 20 can be pushed to the first axial end 11. With the holding unit 20, the ball 50A can be fixed at the standby position inside the ball channel 13. In this second embodiment, the ball can be a tennis, a soft ball or any ball with a slight irregular surface. In addition, the inner side wall of the tube 70 can be mirror polished and treated with chemical nickel, so that the smoothness can be substantially enhanced. Thus, friction can be reduced while the holding unit 20 is sliding along the tube 70. Also, by having the inner diameter of the tube 10 to be greater than the outer diameter of the ball 50A, the flight path and velocity of the ball 50A won't be affected.

Figure 5D:
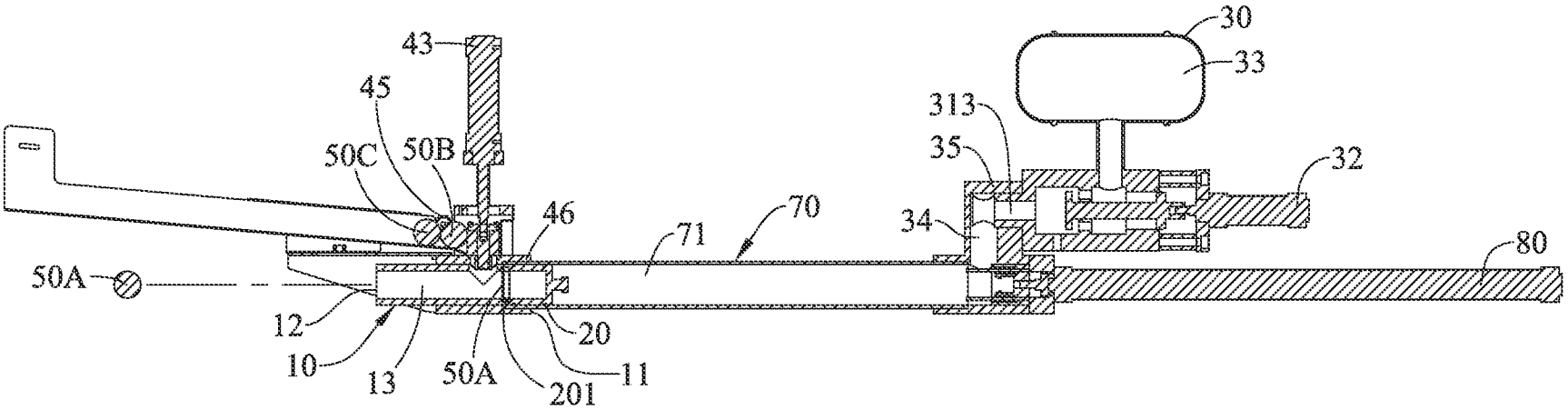

Step 40: As shown in FIG. 4 and FIG. 5D, the holding unit 20 would be stopped by the internal step structure of the ball pathway unit 46, but the ball 50A would leave the sealing ring 201 due to inertial motion. Then, the ball 50A would be ejected out of the tube 10 via the second axial end 12. After the ball 50A is ejected, then go back to Step 10, where the push bar 601*a* is at the standby position, the valve 312 is closed, and the Steps 2040 can be orderly performed to eject another ball. By repeating Steps 1050, the balls can be continuously launched.

Figure 6A:
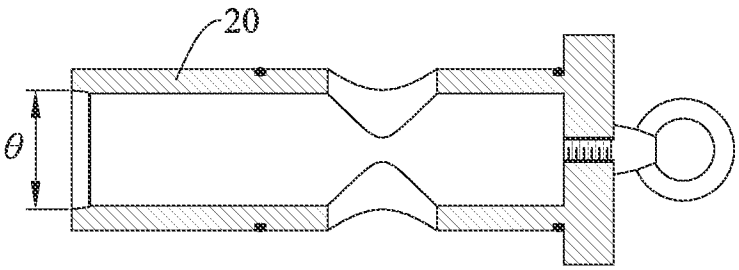
FIG. 6A is a schematic cross-sectional view of another embodiment of the holding unit in accordance with this disclosure.
Figure 6B:
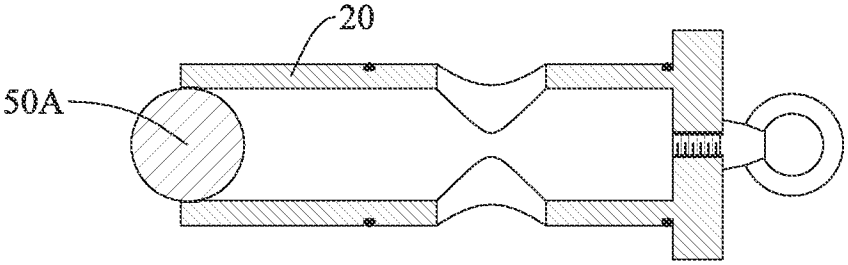
FIG. 6B is a schematic cross-sectional view showing that the holding unit of FIG. 6A holds a ball.

Referring to FIG. 6A, another embodiment of the holding unit is schematically shown in a cross-sectional view. In this embodiment, one end of the holding unit 20 is furnished with a taper opening for holding the ball 50A (see FIG. 6B), and the aforesaid sealing ring 201 is waived. An angle θ of the taper opening can be determined by the size of the ball 50A, preferably ranging from 5 to 10 degrees.

Figure 7A:
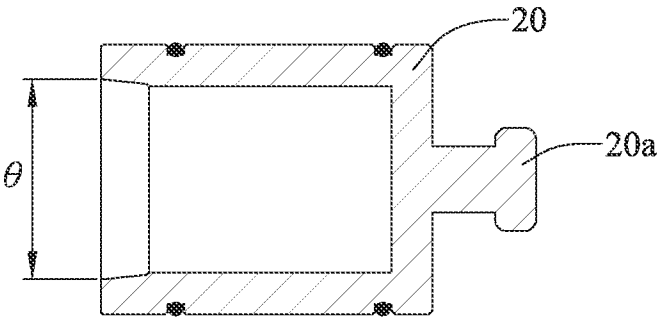
FIG. 7A is a schematic cross-sectional view of a further embodiment of the holding unit in accordance with this disclosure.
Figure 7B:
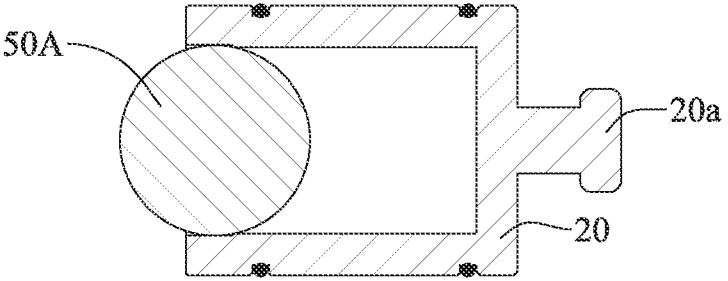
FIG. 7B is a schematic cross-sectional view showing that the holding unit of FIG. 7A holds a ball.

Referring to FIG. 7A, a further embodiment of the holding unit is schematically shown in a cross-sectional view. In this embodiment, one end of the holding unit 20 is furnished with a taper opening for holding the ball 50A (see FIG. 7B), and the aforesaid sealing ring 201 is waived. An angle θ of the taper opening can be determined by the size of the ball 50A, preferably ranging from 5 to 10 degrees.

In summary, the pneumatic ball launcher provided by this disclosure introduces the holding unit to position the ball, so that the ball would be fixed inside the tube without unexpected moment. Thereupon, the aforesaid shortcomings of continuity in launching balls and stability in ejection velocity can be resolved. In addition, by introducing modular designs, the pneumatic ball launcher can be easily adjusted to meet different balls, thus related maintenance and service can be much convenient, and the product reliability can be substantially enhanced.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A pneumatic ball launcher, comprising:

a first tube, having a first axial end, a second axial end opposite to the first axial end, and a first ball channel thereinside to connect spatially the first axial end and the second axial end;

a ball pathway unit, used for connecting one end of the first tube and wrapping part of the first ball channel;

a push unit, having oppositely a third axial end and a fourth axial end, including:

a first push bar, being perpendicular to the first tube, used for protruding into the first ball channel;

a slide base, disposed slidably between the third axial end and the fourth axial end;

a first driver, mounted at the slide base, connected with the first push bar for controlling the first push bar to longitudinally displace in the first ball channel to a fixed position; and a second driver, connected with the slide base for displacing the slide base, used for moving the first push bar along the first tube to further push a ball to approach the first axial end;

a second tube, having one end connected with the ball pathway unit and a second ball channel formed thereinside;

a holding unit, disposed slidably in the second tube for holding the ball pushed by the first push bar;

an airway unit, connected with another end of the second tube;

a third driver, connected with the airway unit, being to buckle the holding unit for controlling the holding unit to displace in the second ball channel; and a pneumatic unit, including:

a valve mechanism, having an exhalation end connected with the airway unit;

a pneumatic cylinder, connected with the valve mechanism at another end thereof opposite to the end connecting the airway unit, used for controlling the valve mechanism to close or open the exhalation end; and a gas tank, connected with the valve mechanism, used for storing a compressed air; wherein, when the valve mechanism opens the exhalation end, the compressed air in the gas tank is discharged into the second tube via the airway unit to eject the ball out of the first tube via the second axial end.

2. The pneumatic ball launcher of claim 1, wherein the third driver utilizes a buckle unit to detachably connect a protrusive portion of the holding unit, and the buckle unit includes:

a buckling portion, used for buckling the protrusive portion of the holding unit; and a pin portion, used for pushing the holding unit to separate the buckling portion from the protrusive portion of the holding unit.

3. The pneumatic ball launcher of claim 2, wherein the third driver utilizes a second push bar to control the buckle unit to displace in the second tube.

4. The pneumatic ball launcher of claim 1, wherein the holding unit has a sealing ring for holding the ball pushed by the first push bar.

5. The pneumatic ball launcher of claim 1, wherein the holding unit has a taper opening for holding the ball pushed by the first push bar.

6. The pneumatic ball launcher of claim 1, wherein the ball pathway unit and the airway unit are detachably connected via the second tube.

7. The pneumatic ball launcher of claim 1, wherein the valve mechanism includes:

an outer casing, having one end formed as the exhalation end, the pneumatic cylinder being disposed at another end of the outer casing opposite to the exhalation end; and a valve, disposed inside the outer casing, having one end thereof connected with the pneumatic cylinder, another end thereof facing the exhalation end, wherein the pneumatic cylinder moves the valve with respect to the exhalation end to close or open the exhalation end.

8. The pneumatic ball launcher of claim 1, wherein the valve mechanism has a compressed gas inlet for introducing a compressed air into the gas tank via the valve mechanism.

9. The pneumatic ball launcher of claim 1, wherein the valve mechanism is connected with one end of the airway unit, another end of the airway unit is spatially connected with the second ball channel, and the airway unit is perpendicular to the second tube.

10. The pneumatic ball launcher of claim 1, wherein the first tube bifurcates a ball-feeding unit, and the ball-feeding unit includes:

a ball pathway, used for carrying a plurality of balls, connected spatially with the first ball channel; and a stop block, disposed at a connection of the ball pathway and the first ball channel, the stop block being displaced between a close position and an open position; wherein, when the stop block is at the close position, a spatial communication between the ball pathway and the first tube is blocked; wherein, when the stop block is at the open position, the spatial communication between the ball pathway and the first tube is made through so as to have the ball in the ball pathway to fall into the first ball channel.

11. The pneumatic ball launcher of claim 1, wherein an inner diameter of the first tube is greater than an outer diameter of the ball, and an inner side wall of the second tube can be mirror polished and treated with chemical nickel.

* * * * *